US008267483B2

(12) United States Patent
Krämer et al.

(10) Patent No.: US 8,267,483 B2
(45) Date of Patent: Sep. 18, 2012

(54) SHANK CHISEL

(75) Inventors: Ulrich Krämer, Wolfach (DE); Markus Roth, Aichhalden (DE)

(73) Assignee: BETEK GmbH & Co. KG (DE)

( * ) Notice: Subject to any disclaimer, the term of this patent is extended or adjusted under 35 U.S.C. 154(b) by 0 days.

(21) Appl. No.: 12/740,017

(22) PCT Filed: Oct. 16, 2008

(86) PCT No.: PCT/EP2008/008756

§ 371 (c)(1),
(2), (4) Date: Jul. 29, 2010

(87) PCT Pub. No.: WO2009/056227

PCT Pub. Date: May 7, 2009

(65) Prior Publication Data

US 2010/0295360 A1 Nov. 25, 2010

(30) Foreign Application Priority Data

Oct. 29, 2007 (DE) ..... 10 2007 051 911

(51) Int. Cl.
*E21C 35/18* (2006.01)

(52) U.S. Cl. ..... 299/104; 299/107; 299/106

(58) Field of Classification Search ..... 299/100–113
See application file for complete search history.

(56) References Cited

U.S. PATENT DOCUMENTS 4,818,027 A 4/1989 Simon
5,088,797 A 2/1992 O'Neill
5,302,005 A 4/1994 O'Neill
5,378,050 A 1/1995 Kammerer et al.
5,683,144 A 11/1997 Kammerer et al.
D420,103 S 2/2000 Rude
D429,262 S 8/2000 Streich
6,199,956 B1 3/2001 Kammerer
6,378,952 B1 4/2002 Moosmann et al.
6,428,111 B1 8/2002 Kammerer
6,508,516 B1 1/2003 Kammerer
6,619,757 B1 * 9/2003 Kammerer ..... 299/104

(Continued)

FOREIGN PATENT DOCUMENTS

DE 3630444 A1 3/1988

(Continued)

OTHER PUBLICATIONS

Exhibit A: PCT Search Report, International Application PCT/EP2008/008756, Oct. 16, 2008 (5 pages).

(Continued)

*Primary Examiner* — John Kreck
*Assistant Examiner* — Yong-Suk (Philip) Ro
(74) *Attorney, Agent, or Firm* — Waddey & Patterson, P.C.; Lucian Wayne Beavers

(57) ABSTRACT

A shank bit, in particular a road milling bit, having a carrier part (10) that comprises a shank (11), the shank (11) carrying a bit tip (18) made of hard material, the carrier part comprising, in the region between the shank and the bit tip, a receiving portion (14) on which a head part is held (30), and the head part comprising a circumferential chip discharge surface (34.1) tapering in a direction toward the bit tip. In order to enable a shank bit of this kind to be designed in wear-optimized fashion, the head part is held rotatably with respect to the carrier part.

21 Claims, 2 Drawing Sheets

U.S. PATENT DOCUMENTS

| | | | | |
|---|---|---|---|---|
| 6,644,755 | B1 | 11/2003 | Kammerer | |
| 6,712,431 | B1 * | 3/2004 | Bosch et al. | 299/104 |
| 6,786,557 | B2 | 9/2004 | Montgomery, Jr. | |
| 6,966,611 | B1 | 11/2005 | Sollami | |
| D520,035 | S | 5/2006 | Kammerer | |
| D558,242 | S | 12/2007 | Chiang | |
| D570,886 | S | 6/2008 | Chiang | |
| D572,735 | S | 7/2008 | Kammerer | |
| 7,490,912 | B2 | 2/2009 | Holl | |
| 2007/0257545 | A1 | 11/2007 | Mouthaan et al. | |
| 2008/0036279 | A1 * | 2/2008 | Hall et al. | 299/105 |
| 2008/0143168 | A1 | 6/2008 | Ferreri et al. | |
| 2008/0202819 | A1 * | 8/2008 | Fader | 175/401 |

FOREIGN PATENT DOCUMENTS

| | | | |
|---|---|---|---|
| DE | 3818213 | A1 | 11/1989 |
| DE | 4127433 | A1 | 3/1992 |
| DE | 19902766 | A1 | 8/2000 |
| DE | 102004053665 | A1 | 5/2006 |

OTHER PUBLICATIONS

U.S. Appl. No. 29/364,290, filed Jun. 22, 2010 to Kammerer.
U.S. Appl. No. 29/364,292, filed Jun. 22, 2010 to Kammerer.
U.S. Appl. No. 29/364,293, filed Jun. 22, 2010 to Kammerer.
U.S. Appl. No. 29/364,294, filed Jun. 22, 2010 to Kammerer.

* cited by examiner

SHANK CHISEL

The invention relates to a shank bit, in particular a road milling bit, having a carrier part that comprises a shank, the shank carrying a bit tip made of hard material, the carrier part comprising, in the region between the shank and the bit tip, a receiving portion on which a head part is held, and the head part comprising a circumferential chip discharge surface tapering in a direction toward the bit tip.

A shank bit of this kind is known from DE 38 18 213 A1. A two-part carrier part, which comprises a shank portion made of steel and a cutting holder, is used here. The cutting holder carries the bit tip in a receptacle, and is soldered to the shank portion. A sleeve-shaped ceramic sheath is arranged in the transition region between the shank portion and the cutting holder.

The ceramic sheath is adhesively bonded both to the cutting holder and to the carrier part. The shank bit rotates during operational service. The hard ceramic sheath grinds, in this context, over a seating surface of a bit holder that carries the shank bit. The ceramic sheath works into the seating surface and wears away the bit holder. Because the bit holder is an expensive component as compared with the shank bit, this effect is undesirable.

De 10 2004 053 665 A1 discloses a shank bit in which a protective sheath, constituting a head part, likewise surrounds the carrier part and is welded to it. A wear protection disk is used to prevent friction between the head part and the bit holder. This additional component increases the part cost of the shank bit.

It is an object of the invention to create a shank bit of the kind mentioned above that is designed in wear-optimized fashion with little parts outlay.

This object is achieved in that the head part is held rotatably with respect to the carrier part. Because of the rotatability of the head part with respect to the carrier part, the carrier part can rotate in the tool insert, and the bit tip wears uniformly. The head part, conversely, can remain unchanged in its position during the load pulse, or can not rotate to the same extent as the carrier part. The possibility thus also exists of placing the head part, if necessary, directly onto a support surface, for example of a bit holder, without exposing the latter to severe rotating wear.

According to a preferred variant embodiment of the invention, provision can be made that the head part is mounted with respect to the carrier part rotatably about the longitudinal center axis of the carrier part.

If a shank bit is configured so that the head part comprises an annular support surface which concentrically surrounds an aperture, and that the carrier part is received in the aperture, the support surface then forms an abutment region that can be placed directly onto the corresponding countersurface of ordinary bit holders. The compressive forces that occur are then introduced from the shank bit directly into the tool holder.

Provision may also preferably be made in this context that the head part comprises, around the aperture, a centering attachment that comprises a centering surface which widens continuously in a direction toward the support surface. The centering attachment then aligns the shank bit on a centering receptacle of the bit holder. The centering receptacle and the centering attachment thus also form a closure system that makes it more difficult for contaminants to penetrate.

For good discharge of the removed stone or bitumen material, provision is made that the head part comprises a concave or conical chip discharge surface whose diameter tapers in a direction toward the bit tip.

The interface between head part and carrier part can be configured so that the head part comprises a bore that forms, with its cylindrical and/or conical bore wall, a seat against which the receiving portion of the carrier part abuts or can abut.

The cylindrical geometry pairing makes possible a very easily rotating association between the head part and carrier part. When a conical fit connection is selected, on the other hand, free and unimpeded rotatability during operational service is limited in favor of improved sealing between the head part and the carrier part. The taper angle of the conical connection can be embodied in a manner adapted to the wear requirements and service conditions.

If provision is made that the head part is braced with respect to the carrier part by means of an elastic support element, the load impacts occurring during operational service can then be cushioned by the elastic support element.

A "pumping" effect can also be generated between the head part and carrier part, so that any contaminants that may have entered can be conveyed out.

In order to obtain a defined positional association between the head part and carrier part, provision can be made that the head part comprises a stop (support portion) and/or a countersurface that limits the installation movement of the head part on the carrier part. A preferred variant of the invention is configured so that the carrier part carries, in the region of the shank, a clamping sleeve; that the head part is pulled onto the clamping sleeve; that the head part holds the clamping sleeve in a preloaded resilient state; and that the head part can be pushed off from the clamping sleeve in such a way that it releases it and the clamping sleeve springs back into its larger-diameter relaxed position. The clamping sleeve is used, in known fashion, to clamp the shank bit replaceably in a receiving bore of the bit holder.

Because the head part preloads the clamping sleeve, the clamping sleeve can easily be inserted into the receiving bore. The head part can then be pushed off from the clamping sleeve, for example with a hammer blow onto the bit tip. The clamping sleeve thereby shifts into its installed position and becomes clamped in the receiving bore.

A wear-optimized configuration of the shank bit results when provision is made that the carrier part comprises, in the region of the end carrying the bit tip, a circumferential collar whose surface transitions into the chip discharge surface and which radially covers the entry cross-section into the seat of the head part. The collar also protects the transition between the head part and the carrier part.

According to a particularly preferred embodiment of the invention, provision is made that the head part and the carrier part have a different material hardness and/or material toughness. The material for the head part, for example, can be made of a hard substance, and the material for the carrier part from a tough substance. If the head part is used in such a way that it is placed directly onto the bit holder, it is then advisable for the bit holder to have, in the contact region with the head part, a greater hardness than the head part.

The invention will be explained below with reference to an exemplifying embodiment depicted in the drawings, in which.

Figure 1:
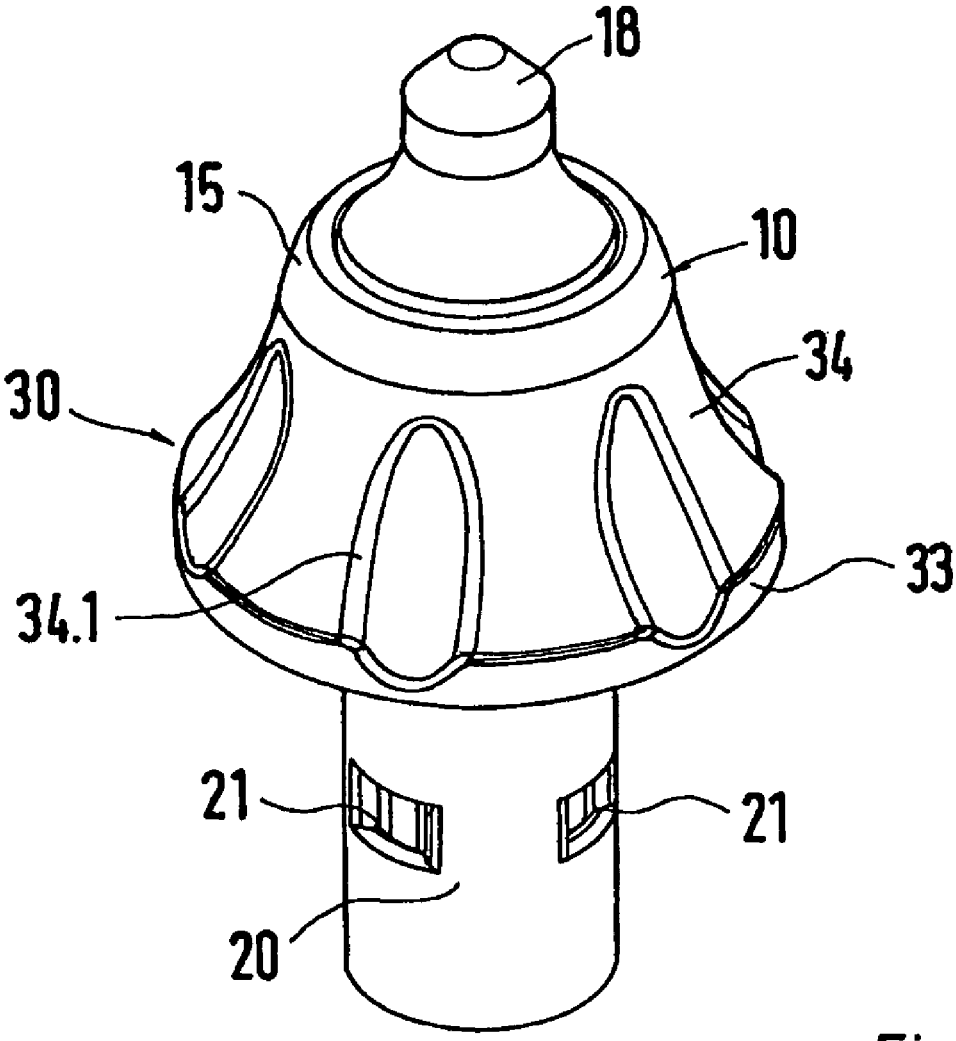
FIG. 1 is a perspective depiction of a shank bit.

FIG. 1 shows a shank bit having a carrier part 10, a head part 30, a clamping sleeve 20, and a bit tip 18 made of carbide metal.

Figure 2:
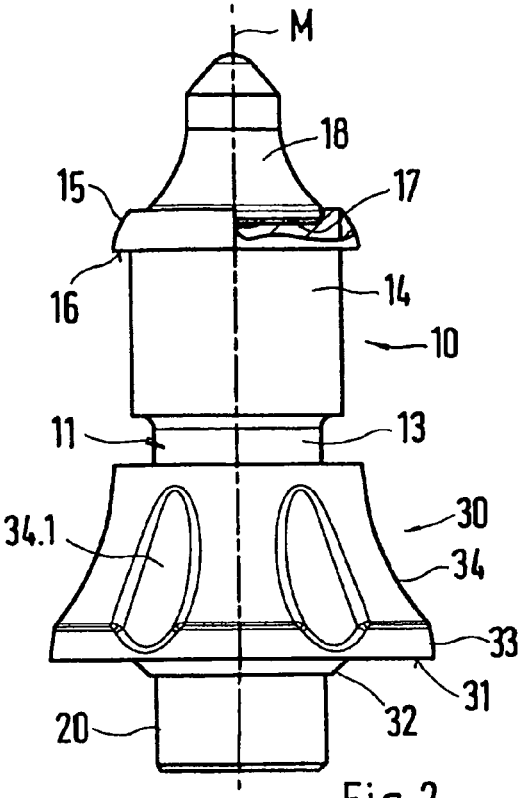
FIG. 2 is a side view and a prepared wraparound view of the shank bit in accordance with FIG. 1.
Figure 4:
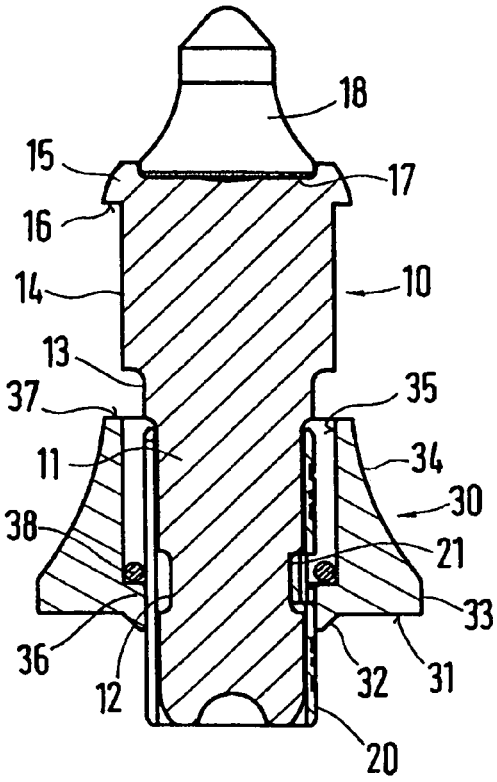
FIG. 4 is a side view and longitudinal section of the shank bit in accordance with FIGS. 2 and 3.
Figure 3:
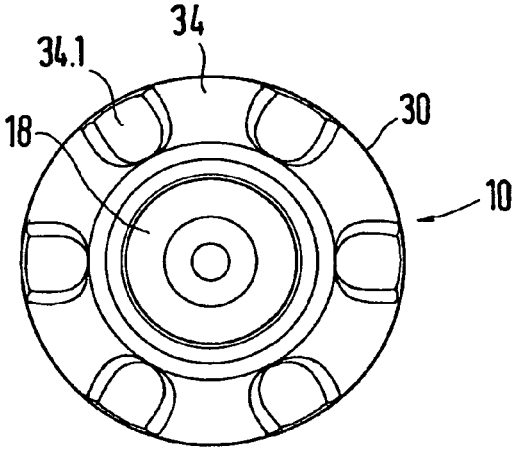
FIG. 3 is a plan view of what is depicted in FIG. 2.

As FIGS. 2 and 4 show, carrier part 10 (manufactured from a steel profile) comprises a cylindrical shank 11. Shank 11 is provided in its central region with a circumferential groove 12.

Clamping sleeve 20, fabricated from a steel sheet and equipped with a longitudinal slot, is pulled onto shank 11. The cylindrical inside cross section of clamping sleeve 20 is dimensioned so that shank 11 can rotate freely in clamping sleeve 20. Clamping sleeve comprises holding elements 21 arranged symmetrically with respect to its transverse central plane. Holding elements 21 engage into groove 12 and hold clamping sleeve 20 on carrier part 10 in lossproof fashion in an axial direction, but freely rotatably. Because of the symmetrical configuration of clamping sleeve 20, the latter can be installed on carrier part 10 in two positions rotated 180°.

Adjacent to shank 11, carrier part 10 comprises a transition portion 13 that leads into a cylindrical receiving portion 14. Receiving portion 14 has an enlarged cross section as compared with shank 11. Adjoining receiving portion 14 is a collar 15 that comprises an abutment surface 16 extending perpendicular to longitudinal center axis 11 of carrier part 10. Adjacent to abutment surface 16, collar 15 is equipped with a convex chip directing surface. Carrier part 10 is equipped in the region of the collar end with a cup-shaped receptacle 17 into which bit tip 18 is soldered.

Head part 30 is fabricated from a metallic material as a pressed part. The rotationally symmetrical head part 30 possesses an annular support surface 31 from which a centering attachment 32 projects. Centering attachment 32 is configured conically, and tapers away from support surface 31. Head part 30 is penetrated concentrically, in the direction of longitudinal center axis M, by an aperture, centering attachment 32 enclosing the entrance opening into said aperture on one side.

The aperture is embodied as a stepped bore, a first diameter being defined by a support portion 36 adjacent to centering attachment 32. Head part 30 is pulled, with this diameter region, onto clamping sleeve 20. The inside diameter is dimensioned to be smaller than the outside diameter of clamping sleeve 20 in its relaxed state.

Clamping sleeve 20 is thereby held with head part 30 in a preloaded state that enables easy installation of the shank bit into a bit holder. The outside diameter of the preloaded clamping sleeve 20 is then dimensioned so that clamping sleeve 20 can easily be pre-fitted into a receiving bore of a bit holder. Adjacent to support portion 36, head part 30 comprises a larger-diameter cylindrical seat 35. The inside diameter of this seat 35 is selected to be the same as or larger than the outside diameter of receiving portion 14. An elastic support element 38 in the form of an O-ring made of rubber is inserted into seat 35, facing toward support portion 36. Head part 30 is equipped on the outer side with a concave chip discharge surface 34 that, in the installed state, transitions in flush fashion into the convex chip directing surface of collar 15. On its side facing away from bit tip 18, chip discharge surface 34 transitions into a cylindrical collar 33, and the latter into support surface 31. Longitudinally directed depressions 34.1 are recessed into chip discharge surface 34 for improved discharge of the removed material.

For installation of the shank bit, the latter is inserted as described above, with its clamping sleeve 20, into the receiving bore of the bit holder until support surface 31 abuts against a corresponding countersurface of the bit holder. By means of a hammer blow onto bit tip 18, head part 30 is displaced with respect to carrier part 10 in the direction of longitudinal center axis M and toward bit tip 18.

In this context, seat 35 moves into the region of receiving portion 14. At the same time, support portion 36 releases clamping sleeve 20, and clamping sleeve 20 springs radially back. It then becomes clamped against the inner wall of the receiving bore of the bit holder.

The displacement motion of head part 30 is limited by abutment surface 16 of collar 15, which comes to a stop against an annularly circumferential countersurface 37 of head part 30.

Collar 15 also holds head part 30 in lossproof fashion, axially in a direction toward bit tip 18, with respect to carrier part 10. At the same time, support portion 36 supports head part 30 with respect to carrier part 10 by way of elastic support element 38. In the opposite direction, the bit holder prevents head part 30 from being pushed away from carrier part 10.

Head part 30 is thus held on carrier part 10 in lossproof fashion axially, but rotatably about the longitudinal center axis.

In the installed state, support element 38 abuts against receiving portion 14 in the region of transition portion 13. In the context of a load on carrier part 10 in an axial direction, support element 38 can be compressed so that it can cushion impact loads.

During tool use, the shank bit strikes with its bit tip 18 against the stone or bitumen material that is to be removed. Carrier part 10 is thereby pressed into seat 35 of head part 30. Carrier part 10 is then braced on countersurface 37 and/or on support portion 36.

The invention claimed is:

1. A shank bit, comprising:

a bit tip;

a carrier part including a shank portion and a receiving portion and a transition portion between the shank portion and the receiving portion, the transition portion having a larger diameter than the shank portion, and the receiving portion having a larger diameter than the transition portion, the carrier part having an outer end connected to the bit tip, the receiving portion being between the shank portion and the outer end;

a head part rotatably receivable on the receiving portion of the carrier part; and a clamping sleeve received about the shank portion, the clamping sleeve having a larger-diameter relaxed position; and wherein the head part includes a cylindrical seat sized to be closely received about the receiving portion, and the head part includes a bore located axially inward of the cylindrical seat, the bore having a smaller-diameter for holding the clamping sleeve in a preloaded resilient state, the smaller-diameter of the bore being smaller than the larger-diameter of the relaxed position of the clamping sleeve;

wherein the head part is movable axially outward relative to the carrier part between an installation position and an installed position;

wherein, in the installation position, the bore of the head part is received about the clamping sleeve and holds the clamping sleeve in the preloaded resilient state; and wherein in the installed position, the bore of the head part is off of the clamping sleeve and the clamping sleeve is in the larger-diameter relaxed position.

2. The shank bit of claim 1, wherein:

the carrier part includes an abutment surface; and the head part includes a stop surface that interacts with the abutment surface to limit axially outward movement of the head part relative to the carrier part.

3. The shank bit of claim 2, wherein:

the abutment surface comprises an axially inward facing radially outward extending surface located axially outward from the receiving portion of the carrier part; and the stop surface of the head part comprises an axially outer end surface of the head part.

4. The shank bit of claim 2, wherein:

the abutment surface comprises an axially inward facing shoulder separating the receiving portion and the transition portion; and the stop surface comprises an axially outward facing surface of a radially inward extending support portion of the head part, the radially inward extending support portion being located axially inward of the cylindrical seat.

5. The shank bit of claim 4, further comprising an elastic support element disposed between the abutment surface of the carrier part and the stop surface of the head part for resiliently bracing the head part with respect to the carrier part.

6. The shank bit of claim 1, wherein:

the carrier part has a longitudinal center axis; and the head part is rotatable about the longitudinal center axis of the carrier part.

7. The shank bit of claim 1, wherein the head part comprises an aperture through which the carrier part is received, and an annular support surface surrounding the aperture and facing away from the bit tip.

8. The shank bit of claim 7, wherein the head part further comprises a centering attachment including a centering surface which widens continuously in a direction toward the annular support surface.

9. The shank bit of claim 1, wherein the head part includes a circumferential chip discharge surface tapering toward the bit tip and the circumferential chip discharge surface of the head part comprises a concave chip discharge surface.

10. The shank bit of claim 1, wherein the bore of the head part receives the transition portion of the carrier part when the head part is in the installed position.

11. The shank bit of claim 10, wherein the bore is a cylindrical bore.

12. The shank bit of claim 1, wherein:

the head part includes a circumferential chip discharge surface tapering toward the bit tip;

the carrier part comprises a circumferential collar adjacent the outer end of the carrier part, the circumferential collar including a radially outer surface which smoothly transitions into the chip discharge surface, the collar covering the axial bore of the head part.

13. The shank bit of claim 1, wherein the head part and the carrier part have a different material hardness from each other.

14. The shank bit of claim 13 wherein the head part and the carrier part have a different material toughness from each other.

15. The shank bit of claim 1, wherein the head part and the carrier part have a different material toughness from each other.

16. The shank bit of claim 1, wherein the shank portion is axially longer than the receiving portion.

17. The shank bit of claim 1, wherein the transition portion is axially shorter than the shank portion.

18. The shank bit of claim 1, wherein the head part includes a circumferential chip discharge surface tapering toward the bit tip.

19. A shank bit, comprising:

a carrier part including a shank portion and a straight cylindrical receiving portion, the carrier part having an outer end, the cylindrical receiving portion being between the shank portion and the outer end, the shank portion having an axial length longer than an axial length of the receiving portion;

a bit tip connected to the outer end of the carrier part, the bit tip being constructed of a harder material than the carrier part;

a head part received on the receiving portion of the carrier part so as to permit relative rotation between the head part and the carrier part;

the head part including an at least partly circumferential outer chip discharge surface tapering toward the bit tip;

the head part having a stepped bore extending axially therethrough, the stepped bore including a straight cylindrical larger diameter bore portion defining a cylindrical seat received about the cylindrical receiving portion of the carrier part, and the stepped bore includes a smaller diameter bore portion located at an end of the head part opposite from the bit tip so that a supporting ledge is defined in the head part at a junction between the larger diameter bore portion and the smaller diameter bore portion, the larger diameter bore portion being axially longer than the smaller diameter bore portion; and wherein the carrier part is axially supported on the supporting ledge of the head part with the cylindrical receiving portion of the carrier part being rotatably received within the cylindrical seat of the head part, so that the carrier part is protected from wear by its location within the head part.

20. The shank bit of claim 19, wherein:

the carrier part includes an abutment shoulder defined on an end of the receiving portion and facing axially away from the bit tip, the abutment shoulder being supported axially from the supporting ledge of the head part.

21. The shank bit of claim 20, further comprising:

an elastic support element disposed between the abutment shoulder and the supporting ledge.

* * * * *